US012577681B2

(12) United States Patent
Zhong et al.

(10) Patent No.: US 12,577,681 B2
(45) Date of Patent: Mar. 17, 2026

(54) METHOD FOR PREPARING COPPER-PLATED TITANIUM ALLOY WIRE REINFORCED ALUMINUM-BASED COMPOSITE MATERIAL

(71) Applicant: Xi'an University of Technology, Xi'an (CN)

(72) Inventors: Lisheng Zhong, Xi'an (CN); Zixuan Dou, Xi'an (CN); Yanwei Wang, Xi'an (CN); Tiandong Wu, Xi'an (CN); Yanqing Zhang, Xi'an (CN); Jianlei Zhu, Xi'an (CN); Yunhua Xu, Xi'an (CN)

(73) Assignee: Xi'an University of Technology, Xi'an (CN)

( * ) Notice: Subject to any disclaimer, the term of this patent is extended or adjusted under 35 U.S.C. 154(b) by 0 days.

(21) Appl. No.: 19/210,356

(22) Filed: May 16, 2025

(65) Prior Publication Data

US 2025/0369122 A1 Dec. 4, 2025

(30) Foreign Application Priority Data

Jun. 3, 2024 (CN) ..... 202410706332.5

(51) Int. Cl.

| | |
|---|---|
| ***C23C 28/02*** | (2006.01) |
| ***C23C 6/00*** | (2006.01) |
| ***C25D 3/38*** | (2006.01) |
| ***C25D 5/38*** | (2006.01) |
| ***C25D 5/50*** | (2006.01) |
| ***C25D 7/06*** | (2006.01) |

(52) U.S. Cl.

CPC ..... *C23C 28/021* (2013.01); *C23C 6/00* (2013.01); *C25D 3/38* (2013.01); *C25D 5/38* (2013.01); *C25D 5/50* (2013.01); *C25D 7/0607* (2013.01)

(58) Field of Classification Search

CPC ..... C23C 28/021

See application file for complete search history.

(56) References Cited

FOREIGN PATENT DOCUMENTS

| | | | | |
|---|---|---|---|---|
| CN | 1895830 A | | 1/2007 | |
| CN | 114713658 | * | 7/2022 | ..... B21C 37/04 |
| CN | 114713658 A | | 7/2022 | |

* cited by examiner

*Primary Examiner* — Dah-Wei D. Yuan
*Assistant Examiner* — Andrew J Bowman

(57) ABSTRACT

The present disclosure discloses a method for preparing a copper-plated titanium alloy wire reinforced aluminum-based composite material, including steps of: etching a cleaned TC4 wire; then electroplating a copper layer to obtain a copper-plated titanium alloy wire; performing heat treatment with two-step slow cooling on the copper-plated titanium alloy wire by using a heat treatment furnace; and, cladding a single-layer and single-pass ER5356 aluminum alloy on an aluminum alloy substrate by an arc additive manufacturing technology, then flatly spreading the heat-treated copper-plated titanium alloy wire in the center of the cladding layer to form an intermediate layer, and finally cladding a single-layer and single-pass ER5356 aluminum alloy matrix on the surface of the intermediate layer. In the present invention, by using copper as a transition interlayer of the aluminum-titanium interface, the generation of brittle intermetallic compounds between aluminum and titanium can be completely suppressed.

3 Claims, 5 Drawing Sheets

METHOD FOR PREPARING COPPER-PLATED TITANIUM ALLOY WIRE REINFORCED ALUMINUM-BASED COMPOSITE MATERIAL

CROSS-REFERENCE TO RELATED APPLICATION

This application claims priority from the Chinese patent application 202410706332.5 filed Jun. 3, 2024, the content of which is incorporated herein in the entirety by reference.

TECHNICAL FIELD

The present disclosure belongs to the technical field of aluminum-based composite materials, and relates to a method for preparing a copper-plated titanium alloy wire reinforced aluminum-based composite material.

BACKGROUND

Due to their advantages of high strength, low density, high damping, high wear resistance or the like, aluminum-based composite materials are widely applied in automobile and aerospace industries. Aluminum-based composite materials using 5xxx series aluminum alloys as matrices have the characteristics of excellent corrosion resistance, weldability or the like, but have not as good tensile strength as aluminum-based composite materials using 2xxx and 7xxx series aluminum alloys as matrices, so their application is limited under high load conditions. Heat treatment is generally used to improve the mechanical strength of a material. However, in practical applications, the aluminum-based composite materials using 5 series aluminum alloys as matrices are difficultly strengthened by heat treatment because the heat treatment will lead to a sharp decline in the elongation of materials and therefore affect the overall mechanical performance of materials. At present, the methods for improving the mechanical performance of aluminum-based composite materials mainly include two methods, i.e., adding continuous reinforcement and adding discontinuous reinforcement. The fiber reinforced aluminum-based composite materials in the continuous reinforcement and the short fiber reinforced aluminum-based composite materials in the discontinuous reinforcement can only be used for manufacturing simple components. Although the whisker, particle and nanoparticle/nanotube reinforced aluminum-based composite materials in the discontinuous reinforcement can improve the hardness and strength of aluminum-based composite materials, but the plasticity and toughness are significantly reduced. Therefore, it is necessary to find new methods to improve strength and ductility. Titanium alloy wires are high in strength, good in thermal stability and corrosion resistance and the like, and have an elongation rate similar to that of aluminum alloys. Embedding titanium alloy wires as continuous fibers into aluminum-based composite materials to improve the mechanical properties of composite materials has a promising application prospect.

Based on the directional energy deposition additive manufacturing technology, the team of Academician Lu Bingheng and Associate Professor Fang Xuewei in the Xi'an Jiaotong University invented a novel additive manufacturing technology for metal continuous fiber reinforced composite materials, which realized the manufacturing of titanium fiber reinforced aluminum (TFRA) components for the first time and greatly improved the overall mechanical performance. Chinese Patent CN106319400A disclosed a high-damping nickel-titanium wire reinforced aluminum-based composite material and a preparation method thereof, wherein the reinforcement phase of the aluminum-based composite material is a nickel-titanium alloy wire which is cast and then hot rolled. The nickel-titanium wire reinforced aluminum-based composite material prepared by this method is excellent in damping performance and mechanical performance. However, since aluminum and titanium greatly differ in physical and chemical properties, brittle intermetallic compounds such as Ti3Al, TiAl, TiAl3 and Ti2Al5 are easily produced during metallurgical reaction in the exiting methods, resulting in poor interfacial performance of manufactured titanium fiber reinforced aluminum-based composite materials.

SUMMARY

The objective of the present disclosure is to provide a method for preparing a copper-plated titanium alloy wire reinforced aluminum-based composite material in order to solve the problem of poor interfacial performance of existing titanium fiber reinforced aluminum-based composite materials.

The present disclosure employs the following technical solutions. A method for preparing a copper-plated titanium alloy wire reinforced aluminum-based composite material is provided, including the following steps of:

- step 1: pretreating a TC4 wire, including etching the cleaned TC4 wire to activate its surface, wherein the composition of titanium alloy TC4 is Ti-6Al-4V;
- step 2: electroplating a copper layer on the etched TC4 wire to obtain a copper-plated titanium alloy wire;
- step 3: performing heat treatment with two-step slow cooling on the copper-plated titanium alloy wire by using a heat treatment furnace, including raising the furnace temperature to 820° C. to 880° C., keeping the temperature for 15 min to 60 min, then performing two-stage slow cooling, and finally cooling to the room temperature along with the furnace; and
- step 4: cladding a single-layer and single-pass ER5356 aluminum alloy on an aluminum alloy substrate by an arc additive manufacturing technology, then flatly spreading the heat-treated copper-plated titanium alloy wire in the center of the cladding layer to form an intermediate layer, and finally cladding a single-layer and single-pass ER5356 aluminum alloy matrix on the surface of the intermediate layer. In step 4, ER5356 is an aluminum alloy wire, which is cladded onto the aluminum alloy substrate in a single-layer and single-pass manner.

The TC4 wire has a diameter of 0.2 mm to 0.5 mm, and the copper-plated layer of the copper-plated titanium alloy wire has a thickness of 50 μm to 80 μm.

In the step 1, pretreating the TC4 wire includes: grinding the surface of the TC4 wire by a piece of sand paper, then pickling with $H_2SO_4$, degreasing with NaOH, cleaning with ethyl alcohol, drying, and finally etching, wherein the concentration of $H_2SO_4$ is 5 wt % to 10 wt %, and the concentration of NaOH is 1 wt % to 3 wt %.

In the step 1, the cleaned TC4 wire is etched using an etching solution, the etching temperature is 35° C. to 50° C., the etching time is 15 min to 30 min, the etching solution is prepared from 10 wt %-15 wt % HF aqueous solution, 10 wt % $NH_4HF_2$, 70 wt % ethylene glycol and 5 wt %-10 wt % $H_2O$, and the volume concentration of the HF aqueous solution is 40%.

In the step 2, during electroplating the copper layer on the etched TC4 wire, the deposition temperature is 60° C. to 80° C., the deposition current is 0.01 A to 0.09 A, and the deposition time is 30 min to 120 min.

In the step 2, during electroplating the copper layer on the etched TC4 wire, the electroplating solution is composed of 55 wt %-83 wt % $CuSO_4 \cdot 5H_2O$, 14 wt %-42 wt % $H_2SO_4$, and <1 wt % emulsifier, sodium sulfonate and sodium chloride, and the total mass percentage of the above components is 100%.

In the step 3, before raising the furnace temperature to 820° C.-880° C., the furnace temperature is raised to 740° C. at 10° C./min and kept for 10 min; the cooling speed in the two-stage slow cooling is 5° C./min; and, the temperature is cooled from 820° C.-880° C. to 740° C. and kept for 5 min in the first stage, and cooled from 740° C. to 500° C. in the second stage.

In the step 4, during cladding the single-layer and single-pass ER5356 aluminum alloy on the aluminum alloy substrate by the arc additive manufacturing technology, the used raw material is an ER5356 aluminum alloy wire, the wire feeding speed is 600 mm/min, the current is 60 A to 100 A, and the flow of pure argon as a protective gas is 15 L/min.

In the step 4, the process of cladding the single-layer and single-pass ER5356 aluminum alloy matrix on the surface of the intermediate layer is the same as the process of cladding the single-layer and single-pass ER5356 aluminum alloy on the aluminum alloy substrate.

The present disclosure has the following beneficial effects.

(1) By using copper as a transition interlayer of the aluminum-titanium interface, the generation of brittle intermetallic compounds between aluminum and titanium can be completely suppressed, thereby improving the interfacial performance and realizing higher strength of the aluminum-titanium interface.

(2) By etching the TC4 wire to activate its surface, electroplating a copper layer and performing heat treatment with two-step slow cooling on the copper-plated titanium alloy wire by using a heat treatment furnace, the binding force between titanium and copper can be effectively improved. In a conventional heat treatment process, the copper base material is severely shrunk due to fast cooling speed, so that crack defects are easy to occur at the interface between the copper base material and the intermetallic compound. In the present application, the cooling process is set as two steps, so the shrinkage of the copper-plated titanium alloy wire can be alleviated, the residual stress can be released, and the formation of micro-cracks at the titanium-copper interface can be avoided.

(3) By embedding the copper-plated titanium alloy wire into the aluminum-based composite material by the arc additive manufacturing technology, the copper-plated titanium alloy wire can hinder the thermal expansion and cold contraction between metal binding layers, and the force is evenly distributed on each metal wire, so that the strength and elongation of the aluminum-based composite material are improved.

(4) Under the action of the copper-plated titanium alloy wire, the bending strength of the aluminum-based composite material is 805 MPa to 917 MPa, which is increased by 21% to 37% compared with the aluminum matrix; and, the impact energy is 47 J to 65 J, which is increased by 95% to 170% compared with the aluminum matrix.

in which: 1: TC4 wire; 2: copper-plated layer; and, 3: ER5356 aluminum alloy matrix.

DETAILED DESCRIPTION OF THE PRESENT DISCLOSURE

The present disclosure will be described below in detail by specific examples with reference to the accompanying drawings.

A method for preparing a copper-plated titanium alloy wire reinforced aluminum-based composite material is provided, including the following steps.

At step 1, a TC4 wire is pretreated, including: grinding the surface of the TC4 wire having a diameter of 0.2 mm to 0.5 mm by a piece of sand paper, then pickling with $H_2SO_4$ with a concentration of 5 wt % to 10 wt %, degreasing with NaOH with a concentration of 1 wt % to 3 wt %, cleaning with ethyl alcohol, drying and finally etching, where the etching temperature is 35° C. to 50° C.; the etching time is 15 min to 30 min; the etching solution is prepared from 10 wt %-15 wt % HF aqueous solution, 10 wt % $NH_4HF_2$, 70 wt % ethylene glycol and 5 wt %-10 wt % $H_2O$; and, the volume concentration of the HF aqueous solution is 40%.

At step 2, the etched TC4 wire 1 is electroplated with a copper layer to obtain a copper-plated titanium alloy wire, where the electroplating solution is composed of 55 wt %-83 wt % $CuSO_4 \cdot 5H_2O$, 14 wt %-42 wt % $H_2SO_4$, and <1 wt % emulsifier, sodium sulfonate and sodium chloride, and the total mass percentage of the above components is 100%; in the electroplating process of the copper layer, the deposition temperature is 60° C. to 80° C., the deposition current is 0.01 A to 0.09 A, and the deposition time is 30 min to 120 min; and, the copper-plated layer 2 of the copper-plated titanium alloy wire has a thickness of 50 μm to 80 μm.

Figure 1:
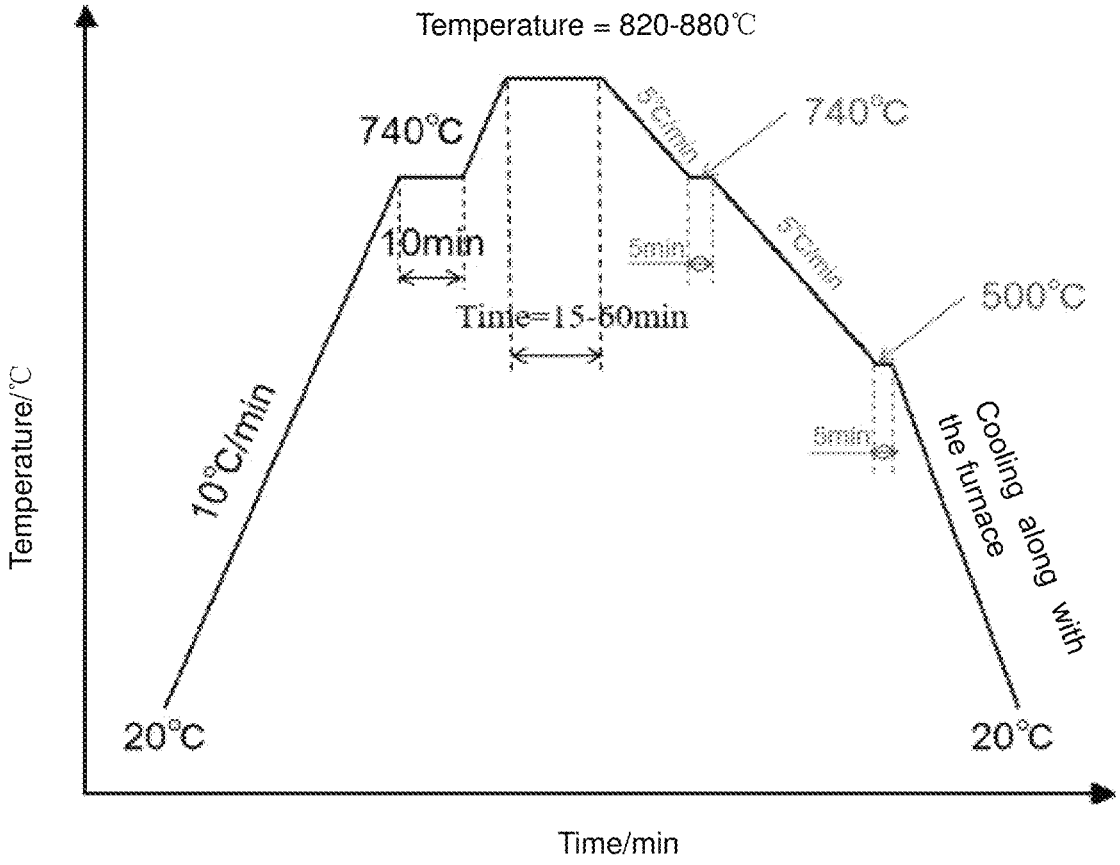
FIG. 1 is a process flowchart of performing heat treatment with two-step slow cooling on the copper-plated titanium alloy wire in the method for preparing a copper-plated titanium alloy wire reinforced aluminum-based composite material according to the present disclosure.

At step 3, referring to FIG. 1, heat treatment with two-step slow cooling is performed on the copper-plated titanium alloy wire by using a heat treatment furnace, including: raising the furnace temperature to 740° C. at 10° C./min and keeping the temperature for 10 min, and then raising the temperature to 820° C. to 880° C. and keeping the temperature for 15 min to 60 min; then, performing two-stage slow cooling, where the cooling speed in the two-stage slow cooling is 5° C./min, and the temperature is cooled from 820° C.-880° C. to 740° C. and kept for 5 min in the first stage and cooled from 740° C. to 500° C. in the second stage; and finally cooling to the room temperature along with the furnace.

At step 4, a single-layer and single-pass ER5356 aluminum alloy is cladded on an aluminum alloy substrate by an arc additive manufacturing technology, where the used raw material is an ER5356 aluminum alloy wire having a diameter of 1.2 mm, the wire feeding speed is 600 mm/min, the current is 60 A to 100 A, and the flow of pure argon as a protective gas is 15 L/min; then, the heat-treated copper-plated titanium alloy wire is flatly spread in the center of the cladding layer to form an intermediate layer; and finally, a single-layer and single-pass ER5356 aluminum alloy matrix is cladded on the surface of the intermediate layer, where the used process is the same as the process of cladding the single-layer and single-pass ER5356 aluminum alloy on the aluminum alloy substrate.

Example 1

A method for preparing a copper-plated titanium alloy wire reinforced aluminum-based composite material is provided, including the following steps.

At step 1, a TC4 wire was pretreated, including: grinding the surface of the TC4 wire having a diameter of 0.2 mm by a piece of sand paper with 60 meshes, then pickling with $H_2SO_4$ with a concentration of 5 wt %, degreasing with NaOH with a concentration of 2 wt %, cleaning with ethyl alcohol with a concentration of 95%, drying and finally etching, where the etching temperature was 35° C.; the etching time was 15 min; the etching solution was prepared from 10 wt % HF aqueous solution, 10 wt % $NH_4HF_2$, 70 wt % ethylene glycol and 10 wt % $H_2O$; and, the volume concentration of the HF aqueous solution was 40%.

At step 2, the etched TC4 wire was electroplated with a copper layer to obtain a copper-plated titanium alloy wire, where the electroplating solution was composed of 55 wt % $CuSO_4 \cdot 5H_2O$, 42 wt % $H_2SO_4$, and <1 wt % emulsifier, sodium sulfonate and sodium chloride, and the total mass percentage of the above components was 100%; and, the deposition temperature was 60° C., the deposition current was 0.01 A, and the deposition time was 120 min.

At step 3, heat treatment with two-step slow cooling was performed on the copper-plated titanium alloy wire by using a heat treatment furnace, including: raising the furnace temperature to 740° C. at 10° C./min and keeping the temperature for 10 min to ensure that the contact surface between the copper-plated layer and the titanium alloy wire was in close contact and to eliminate the micro-voids generated between the copper-plated layer and the surface of the titanium alloy wire during the electroplating process of the copper layer, and then raising the temperature to 820° C. at 10° C./min and keeping the temperature for 30 min; then, performing two-stage slow cooling, where the cooling speed in the two-stage slow cooling was 5° C./min, and the temperature was cooled from 820° C. to 740° C. and kept for 5 min in the first stage and cooled from 740° C. to 500° C. in the second stage; and finally cooling to the room temperature along with the furnace.

Figure 2:
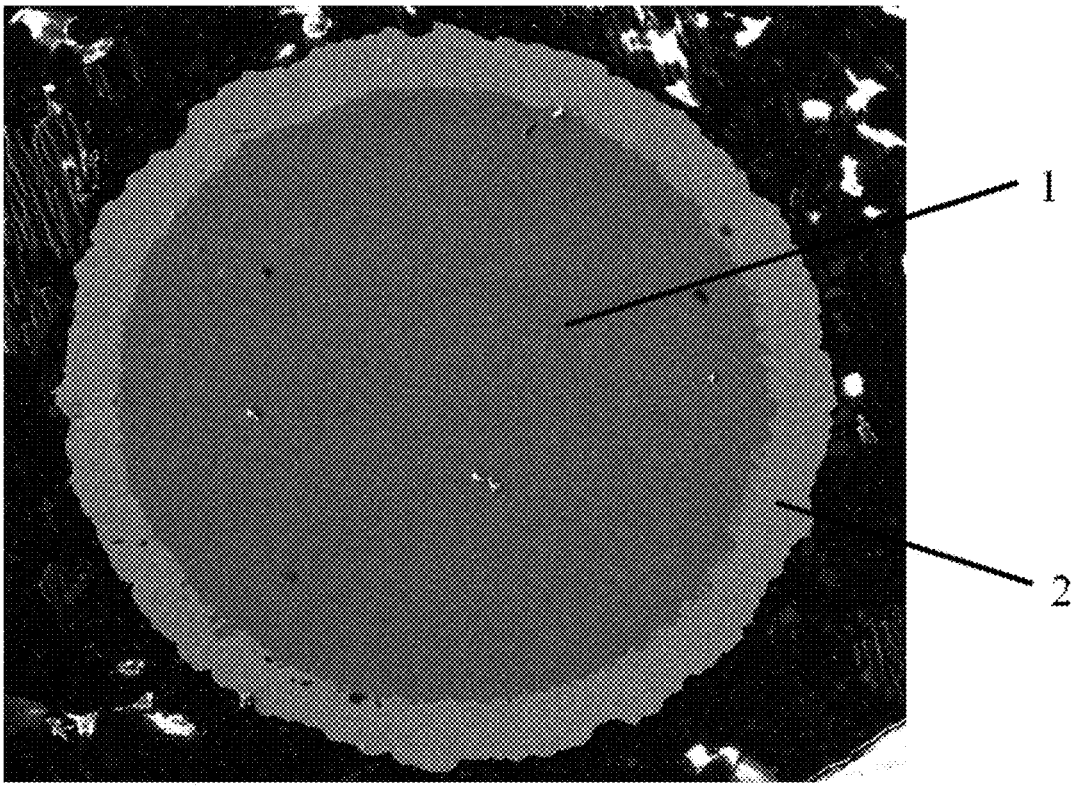
FIG. 2 is a microscopically structure diagram of the copper-plated titanium alloy wire according to Example 1 of the present disclosure.
Figure 3:
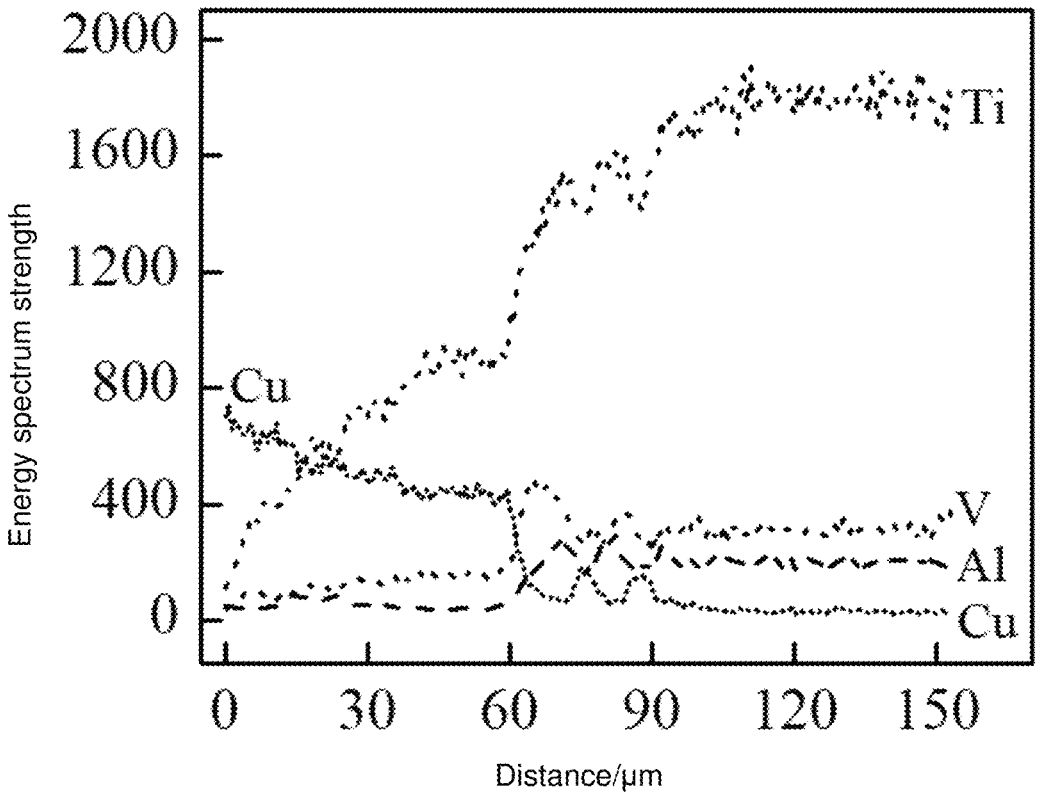
FIG. 3 is a scanning energy spectrum chart of the cross section of the copper-plated titanium alloy wire according to Example 1 of the present disclosure.

The microstructure of the copper-plated titanium alloy wire after the heat treatment with two-step slow cooling was observed, where the cross section structure was shown in FIG. 2, with the TC4 wire 1 inside and the copper-plated layer 2 outside. The elements in the cross section of the copper-plated titanium alloy wire were detected. By taking the outermost layer of the copper-plated titanium alloy wire was taken as an origin and gradually extending inward, a scanning energy spectrum chart of the cross section of the copper-plated titanium alloy wire was shown in FIG. 3. It could be seen from FIG. 3 that, from the inside to the outside of the copper-plated titanium alloy wire, the content of Cu gradually decreased, while the content of Ti, Al and V gradually increased; and near the interface between the TC4 wire 1 and the copper-plated layer 2, the content of Ti, Al and V increased sharply, while the content of Cu decreased sharply decreased, almost to zero. It indicated that the copper-plated layer 2 could hinder the contact of the aluminum alloy matrix with the TC4 wire 1 and completely suppress the generation of brittle intermetallic compounds between aluminum and titanium.

At step 4, a ER5356 aluminum alloy was cladded in a single-layer and single-pass manner on an aluminum alloy substrate by an arc additive manufacturing technology, where the used raw material was an ER5356 aluminum alloy wire having a diameter of 1.2 mm, the wire feeding speed was 600 mm/min, the current was 60 A, and the flow of pure argon as a protective gas was 15 L/min; then, the heat-treated copper-plated titanium alloy wire was flatly spread in the center of the cladding layer to form an intermediate layer; and finally, a single-layer and single-pass ER5356 aluminum alloy matrix 3 was cladded on the surface of the intermediate layer, where the used process was the same as the process of cladding the single-layer and single-pass ER5356 aluminum alloy on the aluminum alloy substrate.

Comparison Example 1

A method for preparing a copper-plated titanium alloy wire reinforced aluminum-based composite material is provided, including the following steps.

At step 1, a TC4 wire was pretreated, including: grinding the surface of the TC4 wire having a diameter of 0.2 mm by a piece of sand paper with 60 meshes, then pickling with $H_2SO_4$ with a concentration of 5 wt %, degreasing with NaOH with a concentration of 2 wt %, cleaning with ethyl alcohol with a concentration of 95%, drying and finally etching, where the etching temperature was 35° C.; the etching time was 15 min; the etching solution was prepared from 10 wt % HF aqueous solution, 10 wt % $NH_4HF_2$, 70 wt % ethylene glycol and 10 wt % $H_2O$; and, the volume concentration of the HF aqueous solution was 40%.

At step 2, the etched TC4 wire 1 was electroplated with a copper layer to obtain a copper-plated titanium alloy wire, where the electroplating solution was composed of 55 wt % $CuSO_4 \cdot 5H_2O$, 42 wt % $H_2SO_4$, and <1 wt % emulsifier, sodium sulfonate and sodium chloride, and the total mass percentage of the above components was 100%; and, the deposition temperature was 60° C., the deposition current was 0.01 A, and the deposition time was 120 min.

At step 3, a single-layer and single-pass ER5356 aluminum alloy was cladded on an aluminum alloy substrate by an arc additive manufacturing technology, where the used raw material was an ER5356 aluminum alloy wire having a diameter of 1.2 mm, the wire feeding speed was 600 mm/min, the current was 60 A, and the flow of pure argon as a protective gas was 15 L/min; then, the copper-plated titanium alloy wire was flatly spread in the center of the cladding layer to form an intermediate layer; and finally, a single-layer and single-pass ER5356 aluminum alloy matrix was cladded on the surface of the intermediate layer, where the used process was the same as the process of cladding the single-layer and single-pass ER5356 aluminum alloy on the aluminum alloy substrate.

Compared with Example 1, in Comparison example 1, the heat treatment with two-step slow cooling was deleted, and other processes were the same.

Figure 4:
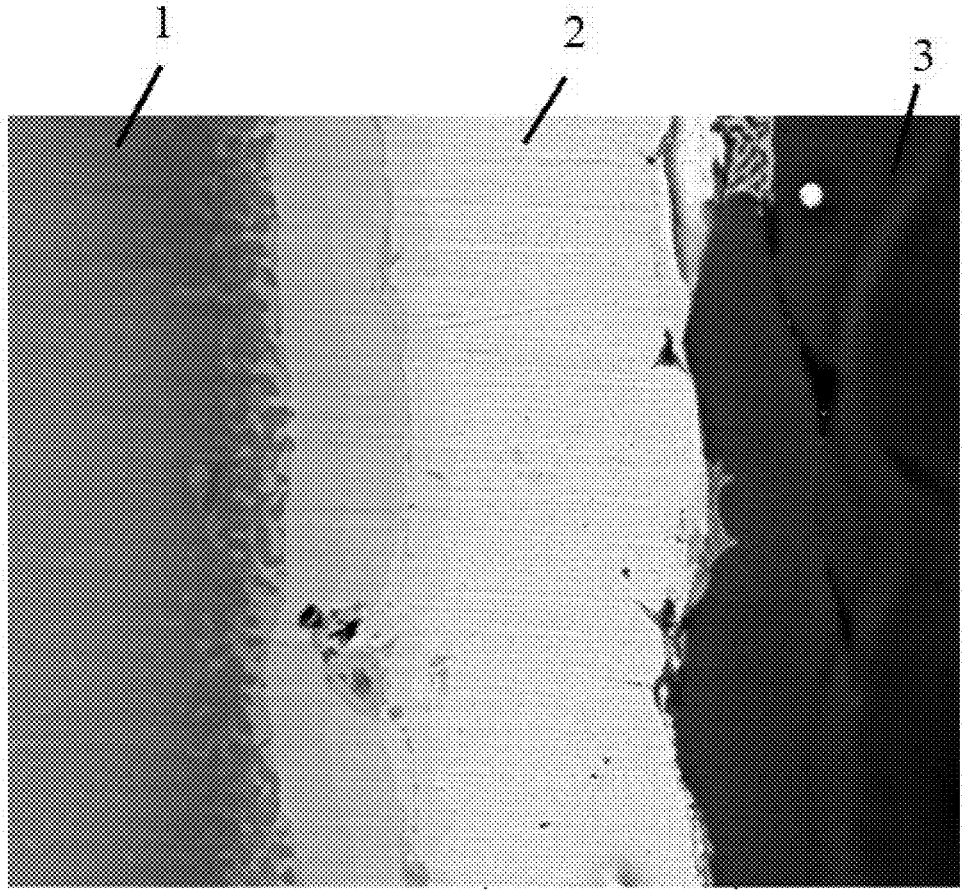
FIG. 4 is an SEM chart of the copper-plated titanium alloy wire reinforced aluminum-based composite material according to Example 1 of the present disclosure.
Figure 5:
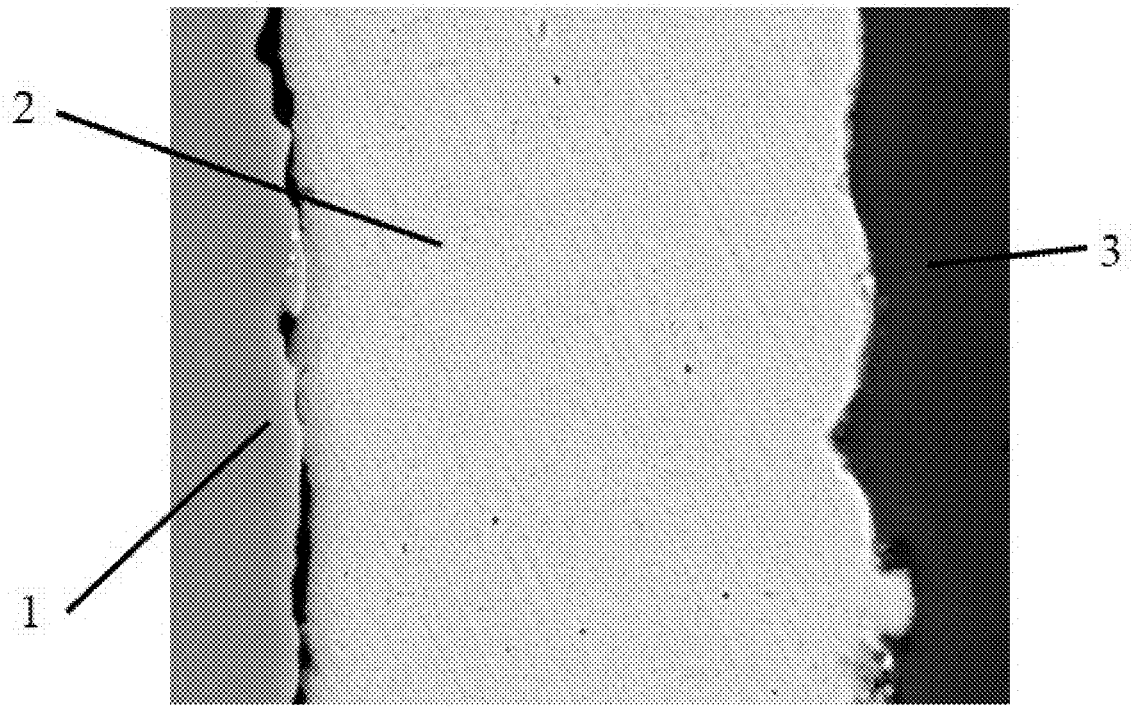
FIG. 5 is an SEM chart of the copper-plated titanium alloy wire reinforced aluminum-based composite material according to Comparison example 1 of the present disclosure.

The microstructures of the copper-plated titanium alloy wire reinforced aluminum-based composite materials prepared in Example 1 and Comparison example 1 were observed, and the observation results were shown in FIGS. 4 and 5, including the TC4 wire 1, the copper-plated layer 2 and the ER5456 aluminum alloy matrix 3. It could be seen that the copper-plated titanium alloy wire reinforced aluminum-based composite material prepared in Example 1 had a good interface state between titanium and copper and had no cracks, while the copper-plated titanium alloy wire reinforced aluminum-based composite material prepared in Comparison example 1 was not subjected to heat treatment with two-step slow cooling and had obvious cracks at the titanium-copper interface. It indicated that the heat treatment with two-step slow cooling could alleviate the shrinkage of the copper-plated titanium alloy wire, release the residual stress and avoid the formation of micro-cracks at the titanium-copper interface.

Example 2

A method for preparing a copper-plated titanium alloy wire reinforced aluminum-based composite material is provided, including the following steps.

At step 1, a TC4 wire was pretreated, including: grinding the surface of the TC4 wire having a diameter of 0.3 mm by a piece of sand paper with 60 meshes, then pickling with $H_2SO_4$ with a concentration of 6 wt %, degreasing with NaOH with a concentration of 1 wt %, cleaning with ethyl alcohol with a concentration of 95%, drying and finally etching, where the etching temperature was 40° C.; the etching time was 20 min; the etching solution was prepared from 12 wt % HF aqueous solution, 10 wt % $NH_4HF_2$, 70 wt % ethylene glycol and 8 wt % $H_2O$; and, the volume concentration of the HF aqueous solution was 40%.

At step 2, the etched TC4 wire was electroplated with a copper layer to obtain a copper-plated titanium alloy wire, where the electroplating solution was composed of 60 wt % $CuSO_4 \cdot 5H_2O$, 37 wt % $H_2SO_4$, and <1 wt % emulsifier, sodium sulfonate and sodium chloride, and the total mass percentage of the above components was 100%; and, the deposition temperature was 70° C., the deposition current was 0.03 A, and the deposition time was 100 min.

At step 3, heat treatment with two-step slow cooling was performed on the copper-plated titanium alloy wire by using a heat treatment furnace, including: raising the furnace temperature to 740° C. at 10° C./min and keeping the temperature for 10 min to ensure that the contact surface between the copper-plated layer and the titanium alloy wire was in close contact and to eliminate the micro-voids generated between the copper-plated layer and the surface of the titanium alloy wire during the electroplating process of the copper layer, and then raising the temperature to 840° C. at 10° C./min and keeping the temperature for 30 min; then, performing two-stage slow cooling, where the cooling speed in the two-stage slow cooling was 5° C./min, and the temperature was cooled from 840° C. to 740° C. and kept for 5 min in the first stage and cooled from 740° C. to 500° C. in the second stage; and finally cooling to the room temperature along with the furnace.

At step 4, a single-layer and single-pass ER5356 aluminum alloy was cladded on an aluminum alloy substrate by an arc additive manufacturing technology, where the used raw material was an ER5356 aluminum alloy wire having a diameter of 1.2 mm, the wire feeding speed was 600 mm/min, the current was 70 A, and the flow of pure argon as a protective gas was 15 L/min; then, the heat-treated copper-plated titanium alloy wire was flatly spread in the center of the cladding layer to form an intermediate layer; and finally, a single-layer and single-pass ER5356 aluminum alloy matrix was cladded on the surface of the intermediate layer, where the used process was the same as the process of cladding the single-layer and single-pass ER5356 aluminum alloy on the aluminum alloy substrate.

Example 3

A method for preparing a copper-plated titanium alloy wire reinforced aluminum-based composite material is provided, including the following steps.

At step 1, a TC4 wire was pretreated, including: grinding the surface of the TC4 wire having a diameter of 0.4 mm by a piece of sand paper with 60 meshes, then pickling with $H_2SO_4$ with a concentration of 7 wt %, degreasing with NaOH with a concentration of 1 wt %, cleaning with ethyl alcohol with a concentration of 95%, drying and finally etching, where the etching temperature was 45° C.; the etching time was 25 min; the etching solution was prepared from 13 wt % HF aqueous solution, 10 wt % $NH_4HF_2$, 70 wt % ethylene glycol and 7 wt % $H_2O$; and, the volume concentration of the HF aqueous solution was 40%.

At step 2, the etched TC4 wire was electroplated with a copper layer to obtain a copper-plated titanium alloy wire, where the electroplating solution was composed of 65 wt % $CuSO_4 \cdot 5H_2O$, 33 wt % $H_2SO_4$, and <1 wt % emulsifier, sodium sulfonate and sodium chloride, and the total mass percentage of the above components was 100%; and, the deposition temperature was 70° C., the deposition current was 0.05 A, and the deposition time was 90 min.

At step 3, heat treatment with two-step slow cooling was performed on the copper-plated titanium alloy wire by using a heat treatment furnace, including: raising the furnace temperature to 740° C. at 10° C./min and keeping the temperature for 10 min to ensure that the contact surface between the copper-plated layer and the titanium alloy wire was in close contact and to eliminate the micro-voids generated between the copper-plated layer and the surface of the titanium alloy wire during the electroplating process of the copper layer, and then raising the temperature to 860° C. at 10° C./min and keeping the temperature for 30 min; then, performing two-stage slow cooling, where the cooling speed in the two-stage slow cooling was 5° C./min, and the temperature was cooled from 860° C. to 740° C. and kept for 5 min in the first stage and cooled from 740° C. to 500° C. in the second stage; and finally cooling to the room temperature along with the furnace.

At step 4, a single-layer and single-pass ER5356 aluminum alloy was cladded on an aluminum alloy substrate by an arc additive manufacturing technology, where the used raw material was an ER5356 aluminum alloy wire having a diameter of 1.2 mm, the wire feeding speed was 600 mm/min, the current was 80 A, and the flow of pure argon as a protective gas was 15 L/min; then, the heat-treated copper-plated titanium alloy wire was flatly spread in the center of the cladding layer to form an intermediate layer; and finally, a single-layer and single-pass ER5356 aluminum alloy matrix was cladded on the surface of the intermediate layer, where the used process was the same as the process of cladding the single-layer and single-pass ER5356 aluminum alloy on the aluminum alloy substrate.

Example 4

A method for preparing a copper-plated titanium alloy wire reinforced aluminum-based composite material is provided, including the following steps.

At step 1, a TC4 wire was pretreated, including: grinding the surface of the TC4 wire having a diameter of 0.5 mm by a piece of sand paper with 60 meshes, then pickling with $H_2SO_4$ with a concentration of 7 wt %, degreasing with NaOH with a concentration of 3 wt %, cleaning with ethyl alcohol with a concentration of 95%, drying and finally etching, where the etching temperature was 45° C.; the etching time was 25 min; the etching solution was prepared from 13 wt % HF aqueous solution, 10 wt % $NH_4HF_2$, 70 wt % ethylene glycol and 7 wt % $H_2O$; and, the volume concentration of the HF aqueous solution was 40%.

At step 2, the etched TC4 wire was electroplated with a copper layer to obtain a copper-plated titanium alloy wire, where the electroplating solution was composed of 70 wt % $CuSO_4 \cdot 5H_2O$, 26 wt % $H_2SO_4$, and <1 wt % emulsifier, sodium sulfonate and sodium chloride, and the total mass percentage of the above components was 100%; and, the deposition temperature was 68° C., the deposition current was 0.06 A, and the deposition time was 80 min.

At step 3, heat treatment with two-step slow cooling was performed on the copper-plated titanium alloy wire by using a heat treatment furnace, including: raising the furnace temperature to 740° C. at 10° C./min and keeping the temperature for 10 min to ensure that the contact surface between the copper-plated layer and the titanium alloy wire was in close contact and to eliminate the micro-voids generated between the copper-plated layer and the surface of the titanium alloy wire during the electroplating process of the copper layer, and then raising the temperature to 880° C. at 10° C./min and keeping the temperature for 30 min; then, performing two-stage slow cooling, where the cooling speed in the two-stage slow cooling was 5° C./min, and the temperature was cooled from 880° C. to 740° C. and kept for 5 min in the first stage and cooled from 740° C. to 500° C. in the second stage; and finally cooling to the room temperature along with the furnace.

At step 4, a single-layer and single-pass ER5356 aluminum alloy was cladded on an aluminum alloy substrate by an arc additive manufacturing technology, where the used raw material was an ER5356 aluminum alloy wire having a diameter of 1.2 mm, the wire feeding speed was 600 mm/min, the current was 90 A, and the flow of pure argon as a protective gas was 15 L/min; then, the heat-treated copper-plated titanium alloy wire was flatly spread in the center of the cladding layer to form an intermediate layer; and finally, a single-layer and single-pass ER5356 aluminum alloy matrix was cladded on the surface of the intermediate layer, where the used process was the same as the process of cladding the single-layer and single-pass ER5356 aluminum alloy on the aluminum alloy substrate.

Example 5

A method for preparing a copper-plated titanium alloy wire reinforced aluminum-based composite material is provided, including the following steps.

At step 1, a TC4 wire was pretreated, including: grinding the surface of the TC4 wire having a diameter of 0.5 mm by a piece of sand paper with 60 meshes, then pickling with $H_2SO_4$ with a concentration of 8 wt %, degreasing with NaOH with a concentration of 1 wt %, cleaning with ethyl alcohol with a concentration of 95%, drying and finally etching, where the etching temperature was 48° C.; the etching time was 28 min; the etching solution was prepared from 15 wt % HF aqueous solution, 10 wt % $NH_4HF_2$, 70 wt % ethylene glycol and 5 wt % $H_2O$; and, the volume concentration of the HF aqueous solution was 40%.

At step 2, the etched TC4 wire was electroplated with a copper layer to obtain a copper-plated titanium alloy wire, where the electroplating solution was composed of 78 wt % $CuSO_4 \cdot 5H_2O$, 20 wt % $H_2SO_4$, and <1 wt % emulsifier, sodium sulfonate and sodium chloride, and the total mass percentage of the above components was 100%; and, the deposition temperature was 70° C., the deposition current was 0.07 A, and the deposition time was 70 min.

At step 3, heat treatment with two-step slow cooling was performed on the copper-plated titanium alloy wire by using a heat treatment furnace, including: raising the furnace temperature to 740° C. at 10° C./min and keeping the temperature for 10 min to ensure that the contact surface between the copper-plated layer and the titanium alloy wire was in close contact and to eliminate the micro-voids generated between the copper-plated layer and the surface of the titanium alloy wire during the electroplating process of the copper layer, and then raising the temperature to 840° C. at 10° C./min and keeping the temperature for 15 min; then, performing two-stage slow cooling, where the cooling speed in the two-stage slow cooling was 5° C./min, and the temperature was cooled from 840° C. to 740° C. and kept for 5 min in the first stage and cooled from 740° C. to 500° C. in the second stage; and finally cooling to the room temperature along with the furnace.

At step 4, a single-layer and single-pass ER5356 aluminum alloy was cladded on an aluminum alloy substrate by an arc additive manufacturing technology, where the used raw material was an ER5356 aluminum alloy wire having a diameter of 1.2 mm, the wire feeding speed was 600 mm/min, the current was 100A, and the flow of pure argon as a protective gas was 15 L/min; then, the heat-treated copper-plated titanium alloy wire was flatly spread in the center of the cladding layer to form an intermediate layer; and finally, a single-layer and single-pass ER5356 aluminum alloy matrix was cladded on the surface of the intermediate layer, where the used process was the same as the process of cladding the single-layer and single-pass ER5356 aluminum alloy on the aluminum alloy substrate.

Example 6

A method for preparing a copper-plated titanium alloy wire reinforced aluminum-based composite material is provided, including the following steps.

At step 1, a TC4 wire was pretreated, including: grinding the surface of the TC4 wire having a diameter of 0.2 mm by a piece of sand paper with 60 meshes, then pickling with $H_2SO_4$ with a concentration of 9 wt %, degreasing with NaOH with a concentration of 2 wt %, cleaning with ethyl alcohol with a concentration of 95%, drying and finally etching, where the etching temperature was 50° C.; the etching time was 30 min; the etching solution was prepared from 15 wt % HF aqueous solution, 10 wt % $NH_4HF_2$, 70 wt % ethylene glycol and 5 wt % $H_2O$; and, the volume concentration of the HF aqueous solution was 40%.

At step 2, the etched TC4 wire was electroplated with a copper layer to obtain a copper-plated titanium alloy wire, where the electroplating solution was composed of 80 wt % $CuSO_4 \cdot 5H_2O$, 17 wt % $H_2SO_4$, and <1 wt % emulsifier, sodium sulfonate and sodium chloride, and the total mass percentage of the above components was 100%; and, the deposition temperature was 80° C., the deposition current was 0.08 A, and the deposition time was 30 min.

At step 3, heat treatment with two-step slow cooling was performed on the copper-plated titanium alloy wire by using a heat treatment furnace, including: raising the furnace temperature to 740° C. at 10° C./min and keeping the temperature for 10 min to ensure that the contact surface between the copper-plated layer and the titanium alloy wire was in close contact and to eliminate the micro-voids generated between the copper-plated layer and the surface of the titanium alloy wire during the electroplating process of the copper layer, and then raising the temperature to 840° C. at 10° C./min and keeping the temperature for 45 min; then, performing two-stage slow cooling, where the cooling speed in the two-stage slow cooling was 5° C./min, and the temperature was cooled from 840° C. to 740° C. and kept for 5 min in the first stage and cooled from 740° C. to 500° C. in the second stage; and finally cooling to the room temperature along with the furnace.

At step 4, a single-layer and single-pass ER5356 aluminum alloy was cladded on an aluminum alloy substrate by an arc additive manufacturing technology, where the used raw material was an ER5356 aluminum alloy wire having a diameter of 1.2 mm, the wire feeding speed was 600 mm/min, the current was 70 A, and the flow of pure argon as a protective gas was 15 L/min; then, the heat-treated copper-plated titanium alloy wire was flatly spread in the center of the cladding layer to form an intermediate layer; and finally, a single-layer and single-pass ER5356 aluminum alloy matrix was cladded on the surface of the intermediate layer, where the used process was the same as the process of cladding the single-layer and single-pass ER5356 aluminum alloy on the aluminum alloy substrate.

Example 7

A method for preparing a copper-plated titanium alloy wire reinforced aluminum-based composite material is provided, including the following steps.

At step 1, a TC4 wire was pretreated, including: grinding the surface of the TC4 wire having a diameter of 0.4 mm by a piece of sand paper with 60 meshes, then pickling with $H_2SO_4$ with a concentration of 10 wt %, degreasing with NaOH with a concentration of 3 wt %, cleaning with ethyl alcohol with a concentration of 95%, drying and finally etching, where the etching temperature was 50° C.; the etching time was 30 min; the etching solution was prepared from 15 wt % HF aqueous solution, 10 wt % $NH_4HF_2$, 70 wt % ethylene glycol and 5 wt % $H_2O$; and, the volume concentration of the HF aqueous solution was 40%.

At step 2, the etched TC4 wire was electroplated with a copper layer to obtain a copper-plated titanium alloy wire, where the electroplating solution was composed of 83 wt % $CuSO_4 \cdot 5H_2O$, 15 wt % $H_2SO_4$, and <1 wt % emulsifier, sodium sulfonate and sodium chloride, and the total mass percentage of the above components was 100%; and, the deposition temperature was 80° C., the deposition current was 0.09 A, and the deposition time was 40 min.

At step 3, heat treatment with two-step slow cooling was performed on the copper-plated titanium alloy wire by using a heat treatment furnace, including: raising the furnace temperature to 740° C. at 10° C./min and keeping the temperature for 10 min to ensure that the contact surface between the copper-plated layer and the titanium alloy wire was in close contact and to eliminate the micro-voids generated between the copper-plated layer and the surface of the titanium alloy wire during the electroplating process of the copper layer, and then raising the temperature to 840° C. at 10° C./min and keeping the temperature for 60 min; then, performing two-stage slow cooling, where the cooling speed in the two-stage slow cooling was 5° C./min, and the temperature was cooled from 840° C. to 740° C. and kept for 5 min in the first stage and cooled from 740° C. to 500° C. in the second stage; and finally cooling to the room temperature along with the furnace.

At step 4, a single-layer and single-pass ER5356 aluminum alloy was cladded on an aluminum alloy substrate by an arc additive manufacturing technology, where the used raw material was an ER5356 aluminum alloy wire having a diameter of 1.2 mm, the wire feeding speed was 600 mm/min, the current was 80 A, and the flow of pure argon as a protective gas was 15 L/min; then, the heat-treated copper-plated titanium alloy wire was flatly spread in the center of the cladding layer to form an intermediate layer; and finally, a single-layer and single-pass ER5356 aluminum alloy matrix was cladded on the surface of the intermediate layer, where the used process was the same as the process of cladding the single-layer and single-pass ER5356 aluminum alloy on the aluminum alloy substrate.

The mechanical properties of the ER5356 aluminum alloy matrix, the TC4 wire without copper plated (having a diameter of 0.2 mm) and the copper-plated titanium alloy wire reinforced aluminum-based composite materials prepared in Examples 1-7 were tested, and the test results were shown in Table 1 below:

TABLE 1

List of mechanical properties of the aluminum alloy matrix, the TC4 wire without copper plated and the samples prepared in Examples 1-7

| Test samples | Maximum temperature for heat treatment/° C. | Heat treatment time at the maximum temperature/min | Bending strength/Mpa | Impact energy/J |
|---|---|---|---|---|
| Aluminum alloy matrix | \ | \ | 619 | 14 |
| TC4 wire without copper plated | \ | \ | 726 | 32 |
| Example 1 | 820 | 30 | 826 | 53 |
| Example 2 | 840 | 30 | 849 | 65 |
| Example 3 | 860 | 30 | 911 | 56 |
| Example 4 | 880 | 30 | 805 | 47 |
| Example 5 | 840 | 15 | 805 | 48 |
| Example 6 | 840 | 45 | 917 | 59 |
| Example 7 | 840 | 60 | 852 | 53 |

It could be seen from Table 1 that the copper-plated titanium alloy wire reinforced aluminum-based composite material prepared by the method of the present disclosure was good in strength and ductility.

The invention claimed is:

1. A method for preparing a copper-plated titanium alloy wire reinforced aluminum-based composite material, comprising the following steps of:

step 1: pretreating a TC4 wire, comprising etching a cleaned TC4 wire; wherein, in the step 1, pretreating the TC4 wire comprises: grinding the surface of the TC4 wire by a piece of sand paper, then pickling with H2SO4, degreasing with NaOH, cleaning with ethyl alcohol, drying, and finally etching, wherein the concentration of H2SO4 is 5 wt % to 10 wt %, and the concentration of NaOH is 1 wt % to 3 wt %; and the cleaned TC4 wire is etched using an etching solution, the etching temperature is 35° C. to 50° C. and the etching time is 15 min to 30 min; the etching solution is composed of 10 wt %-15 wt % HF aqueous solution, 10 wt % NH4HF2, 70 wt % ethylene glycol and 5 wt %-10 wt % H20 and the total mass percentage of the etching solution is 100%; wherein the volume concentration of the HF aqueous solution is 40%, thereby forming an etched TC4 wire;

step 2: electroplating a copper layer on the etched TC4 wire to obtain a copper-plated titanium alloy wire; wherein the etched TC4 wire has a diameter of 0.2 mm to 0.5 mm and a copper-plated layer of the copper-plated titanium alloy wire has a thickness of 50 μm to 80 μm: wherein, in the step 2, during electroplating the copper layer on the etched TC4 wire, an electroplating solution is composed of 55 wt %-83 wt % CuSO4·5H20, 14 wt %-42 wt % H2SO4, <1 wt % emulsifier, <1 wt % sodium sulfonate and <1 wt % sodium chloride, and the total mass percentage of the electroplating solution is 100%, the electroplating temperature is 60° C. to 80° C., the electroplating current is 0.01 A to 0.09 A and the electroplating time is 30 min to 120 m;

step 3: performing heat treatment with two-step slow cooling on the copper-plated titanium alloy wire by using a heat treatment furnace, comprising raising the furnace temperature to 820° C. to 880° C. at 100 C/min, keeping the temperature for 15 min to 60 min, then performing two-stage slow cooling, and finally cooling to room temperature along with the furnace; wherein, in the step 3, before raising the furnace temperature to 820° C. to 880° C., the furnace temperature is raised to 740° C. at 10° C./min and kept for 10 min, the cooling speed in the two-stage slow cooling is 5° C./min and the temperature is cooled from 820° C.-880° C. to 740° C. and kept for 5 min in a first stage and cooled from 740° C. to 500° C. in a second stage;

and step 4: cladding a single-layer and single-pass ER5356 aluminum alloy on an aluminum alloy substrate by an arc additive manufacturing technology, then spreading the heat-treated copper-plated titanium alloy wire in the center of the single-layer to form an intermediate layer and finally cladding the single-layer and single-pass ER5356 aluminum alloy matrix on the surface of the intermediate layer.

2. The method for preparing a copper-plated titanium alloy wire reinforced aluminum-based composite material according to claim 1, wherein, in the step 4, during cladding the single-layer and single-pass ER5356 aluminum alloy on the aluminum alloy substrate by the arc additive manufacturing technology, a used raw material is an ER5356 aluminum alloy wire, the ER5356 aluminum alloy wire feeding speed is 600 mm/min, a current is 60 A to 100 A, and a flow of pure argon as a protective gas is 15 L/min.

3. The method for preparing a copper-plated titanium alloy wire reinforced aluminum-based composite material according to claim 2, wherein, in the step 4, cladding the single-layer and single-pass ER5356 aluminum alloy matrix on the surface of the intermediate layer is the same as cladding the single-layer and single-pass ER5356 aluminum alloy on the aluminum alloy substrate.

* * * * *